US007451834B2

(12) United States Patent
Shears et al.

(10) Patent No.: US 7,451,834 B2
(45) Date of Patent: Nov. 18, 2008

(54) IMPACT ENHANCING APPARATUS AND METHOD

(75) Inventors: Carl Shears, Aberdeenshire (GB); Sigurd Solem, Grestedbro (DK)

(73) Assignee: Pedem Limited, Bridge of Don Aberdeen (GB)

( * ) Notice: Subject to any disclaimer, the term of this patent is extended or adjusted under 35 U.S.C. 154(b) by 350 days.

(21) Appl. No.: 11/159,418

(22) Filed: Jun. 23, 2005

(65) Prior Publication Data

US 2005/0284665 A1 Dec. 29, 2005

(30) Foreign Application Priority Data

Jun. 23, 2004 (GB) ..... 0413996.0

(51) Int. Cl.
*E21B 10/38* (2006.01)

(52) U.S. Cl. ..... 175/57; 175/296; 166/301

(58) Field of Classification Search ..... None
See application file for complete search history.

(56) References Cited

U.S. PATENT DOCUMENTS 4,844,157 A 7/1989 Taylor et al.
4,846,273 A * 7/1989 Anderson et al. ..... 166/178
5,139,086 A 8/1992 Griffith, Sr. et al.
5,232,060 A 8/1993 Evans et al.
5,624,001 A 4/1997 Evans et al.
5,918,689 A 7/1999 Roberts et al.
6,135,217 A * 10/2000 Wilson ..... 175/297
6,328,101 B1 12/2001 Friis
2005/0287854 A1 12/2005 Shears et al.

* cited by examiner

*Primary Examiner*—Jennifer H Gay
(74) *Attorney, Agent, or Firm*—Foley & Lardner LLP

(57) ABSTRACT

An impact enhancer apparatus includes: a substantially tubular inner member, a substantially tubular outer member that is axially movable in relation to the inner member, a primary energy storage device adapted to store energy when the inner member is moved in either of first and second axial directions with respect to the outer member and a secondary energy storage device adapted to store energy when the inner member is moved in a first axial direction with respect to the outer member. The primary energy storage device may include a primary biasing device. The secondary energy storage device may include a secondary biasing device. The primary and/or secondary biasing devices may be a spring device such as a disk spring, a coiled spring, a fluid spring, a gas spring, etc. The impact enhancing devices may include tubular members that have double shoulder high torque connections.

19 Claims, 4 Drawing Sheets

12
42
10
24
102
32
38
22
82
78
75
76
80
14
34
36
L 12
10
18
46
242
244
52
48
16
104
30
84
44
24
40
J1
L 98
10
12
100
28
20
108
94
29
74
106
72
50
26
J3
J2
54
L

IMPACT ENHANCING APPARATUS AND METHOD

CROSS-REFERENCE TO RELATED APPLICATIONS

This application claims priority to GB 0413996.0, which was filed on Jun. 23, 2004 and which is incorporated by reference herein in its entirety.

BACKGROUND

The present invention relates to a method and an apparatus for enhancing the impact created by a drilling jar used downhole when the drill string becomes stuck.

Drilling jars are used widely in the drilling industry to allow a jarring impact to be transmitted to the drill string when, for example, the drill string becomes stuck in the borehole in which the drilling operation is being performed.

Drilling jars may be incorporated into a bottom hole assembly of a drill string and comprise an outer tubular housing which surrounds an inner tubular member. The outer tubular housing may be connected at its lower end to the lower portion of the drill string while the upper end of the inner tubular member is connected to the upper portion of the drill string. The inner member and outer housing are telescopically connected such that one may move axially with respect to the other. Generally, the inner member of a drilling jar has an abutment that acts as a hammer and coincides with an internal shoulder provided on the outer housing of the jar that acts as an anvil such that the free stroke of the inner member with respect to the outer housing causes the hammer to impact against the anvil. This impact causes the lower drill string portion to jar.

The impact momentum (also referred to as "impact force") created by the jar is the speed of the hammer multiplied by the hammer weight at the time of impact, where the hammer weight is the weight of any drill collars and/or heavy weight pipe located between the jar hammer and drill pipe or energizer.

The impact force between the hammer and anvil may be increased using an impact enhancing tool that employs energy storage means that can be used to store energy, which when suddenly released causes the inner member of the jar to accelerate with respect to the outer housing of the jar, while the hammer is moving toward the anvil.

Unfortunately, in conventional drilling strings, the pins and boxes are subject to stretching both when the tubular members are connected and during drilling.

What is needed, therefore, is an apparatus and a methodology that address at least one if not more of the deficiencies that afflict conventional practice, as previously described.

SUMMARY

According to a first embodiment of the present invention, there is provided an impact enhancer apparatus that includes, among other possible things: a substantially tubular inner member; a substantially tubular outer member which is axially movable in relation to the inner member; a primary energy storage means adapted to store energy when the inner member is moved in either of first and second axial directions with respect to the outer member; and a secondary energy storage means adapted to store energy when the inner member is moved in a first axial direction with respect to the outer member.

The primary energy storage means may include a primary resilient means which may comprise a primary biasing means which may be any one of a spring means (such as disk springs, coiled springs, fluid or gas springs, etc.). The secondary energy storage means may include a secondary resilient means which may comprise a secondary biasing means which may be any one of a spring means (such as disk springs, coiled springs, fluid or gas springs, etc.).

The primary energy storage means may be adapted to store energy when compressed by movement of the inner member in either of the first and second axial direction with respect to the outer member.

The secondary energy storage means may be adapted to store energy when compressed by movement of the inner member in the first axial direction with respect to the outer member.

The primary and secondary energy storage means may be adapted to resist movement (and thereby store energy) of the inner member in the upward direction with respect to the outer member with a relatively large resistive force. Moreover, the primary energy storage means may be adapted to resist movement (and thereby store energy) of the inner member in the downward direction with respect to the outer member with a relatively weak resistive force. Further, only the primary energy storage means may be adapted to resist movement (and thereby store energy) of the inner member in the downward direction with respect to the outer member with a relatively weak resistive force.

The primary energy storage means may be adapted to resist upward movement of the inner member with respect to the outer member by a first resilient force when the inner member is displaced to an upward displacement boundary and the secondary energy storage means is adapted to resist upward movement of the inner member with respect to the outer member by a second resilient force when the inner member is displaced past the upward displacement boundary.

The primary and secondary energy storage means may include a plurality of resilient disks. Alternatively, the primary and secondary energy storage means comprise any suitable resilient member such as a coiled spring or the like.

The primary energy storage means may be adapted to provide a lower level of resistive force to compression than that provided by the secondary energy storage means.

The difference in the level of resistive force provided by the energy storage means may be determined due to the orientation of the energy storage means which selectively results in a greater or lesser compression displacement when substantially the same force is placed upon the energy storage means.

The primary energy storage means may include a plurality of spring disks (such as two) oriented in the same direction as one another. The plurality of disks in the primary resilient means may be arranged with two disks oriented in one direction alternating with two disks oriented in the other direction.

The secondary energy storage means may include a plurality of spring disks (such as four) oriented in the same direction as one another. The plurality of disks in the secondary energy storage means may be arranged with a greater number (such as twice the number) of disks of the primary energy storage means oriented in one direction alternating with the same greater number of spring disks oriented in the other direction.

Movement of the inner member in the upward direction may cause the primary and secondary energy storage means to be compressed until the upward displacement limit is reached at which point further upward movement of the inner member only causes the secondary energy storage means to be compressed further.

Movement of the inner member in the downward direction may cause only the primary energy storage means to be compressed, the secondary energy storage means may be allowed to move with the inner member without being compressed.

The energy storage means may be located in an annulus formed between the inner and outer members.

The primary energy storage means may be located within the annulus and are further located between a second arrangement of upper and lower shoulders formed on the inner member and may be further located between a lower shoulder formed on the outer member and a lower shoulder formed on the moveable member.

The secondary energy storage means may be located within the annulus and are further located between a first arrangement of upper and lower shoulders formed on the inner member and may be further located between an upper shoulder formed on the outer member and an upper shoulder formed on a moveable member that may also be located in the annulus.

The moveable member may be located in the annulus between the primary and secondary energy storage means and may include a greater axial extent and thus a greater distance between it's upper and lower shoulders than the distance between the inner member lower shoulder of the first arrangement and the inner member upper shoulder of the second arrangement.

The impact enhancing apparatus may be arranged such that, in the absence of compression to the energy storage means, the distance between the upper shoulder of the first arrangement and the upper shoulder of the second arrangement substantially equals the distance between the upper shoulder of the outer member and the lower shoulder of the moveable member.

According to the another embodiment of the present invention, there is also provided a method of increasing the jarring force imparted by a jar apparatus. This method includes, among other possible steps: providing a substantially tubular inner member; providing a substantially tubular outer member; and providing an energy storage means capable of storing greater energy therein due to upward movement of the inner member with respect to the outer member.

According to a second embodiment of the present invention, there is provided connection means adapted to allow connection of one substantially tubular member to another substantially tubular member. The connection means includes, among other possible things: a male connecting member; a female connecting member; and co-operable attachment means provided on the male and female connecting members. The male and female connecting members each comprise at least one primary surface adapted to form a primary joint and further each comprise at least one secondary surface adapted to form a secondary joint.

According to the second embodiment of the present invention, there is also provided a male connecting member for a substantially tubular member which is arranged for connection to a female connecting member of another substantially tubular member. The male connecting member includes, among other possible things: an attachment means co-operable with an attachment means provided on the female connecting member; at least one primary surface adapted to form a primary joint with at least one primary surface provided on the female member; and at least one secondary surface adapted to form a secondary joint with at least one secondary surface provided on the female member.

According to the second embodiment of the present invention, there is also provided a female connecting member for a substantially tubular member which is arranged for connection to a male connecting member of another substantially tubular member. The female connecting member includes, among other possible things: an attachment means co-operable with an attachment means provided on the male connecting member; at least one primary surface adapted to form a primary joint with at least one primary surface provided on the male member; and at least one secondary surface adapted to form a secondary joint with at least one secondary surface provided on the male member.

The tubular member may connect with another tubular member in accordance with the first embodiment of the present invention to form at least part of the outer housing of a downhole tool for incorporation into a string of downhole tubular members such as drill string.

An end the male member may be adapted for insertion into an end of the female member.

The at least one primary surface may be adapted to form a primary load bearing shoulder joint and moreover, the at least one secondary surface may be adapted to form a secondary load bearing shoulder joint. The primary and secondary joints may be formed between the male and female connecting members when the male and female connecting members are connected to one another.

The co-operable attachment means of the male and female connecting members may retain the primary surface of the male connecting member in abutment with the primary surface of the female connecting member.

The co-operable attachment means of the male and female connecting members may retain the secondary surface of the male connecting member in abutment with the secondary surface of the female connecting member.

The co-operable attachment means of the male and female connecting members may retain the primary and secondary surfaces of the male connecting member in abutment with the respective primary and secondary surfaces of the female connecting member, perhaps in order to create the respective primary and secondary joints between the male and female members. Moreover, at least one of the primary and secondary joints may at least partially resist rotation of one of the connecting members with respect to the other in at least one direction.

This has the advantage that embodiments of the invention provide a pair of butting surfaces (between each pair of primary and secondary surfaces) between the male and female members which resist rotation of the members with respect to one another.

The attachment means may include a thread on the male member which is co-operable with a corresponding thread on the female member. Moreover, the thread may force the or each primary and/or secondary surface of the connecting members into abutment with the corresponding surface of the other connecting member. The thread provided on the male and female members may include a substantially parallel thread which may include a longitudinal axis which is substantially parallel to a longitudinal axis of the respective tubular member. This provides the advantage that the attachment means has a minimized radial extent which means that the inner bore of the connection members is substantially unrestricted at the location of the connection members. Optionally in alternative embodiments, the thread provided on the male and female members may comprise a linearly tapered thread which is at an angle to the central longitudinal axis of the respective tubular member, where the thread angle may be arranged with one end of the thread radially closer to the central longitudinal axis of the connecting members than the other end of the thread.

The primary surface of the female member may be located radially outwardly of the secondary surface; the secondary surface of the female member is located closer to the central longitudinal axis of the female connecting member than the primary surface.

The primary surface of the male member may be located radially outwardly of the secondary surface; the secondary surface of the male member is located closer to the central longitudinal axis of the male connecting member than the primary surface.

The respective attachment means of the male and female members may be located in between the respective primary and secondary surfaces.

The primary surface of the female member may include a longitudinally outermost end of the female member and may be provided at an end of the female member which is longitudinally and radially outer of the female member attachment means. The secondary surface of the female member may be distal of the longitudinally outermost end of the female member and may be provided radially and longitudinally inner of the female member attachment means.

The secondary surface of the male member may include a longitudinally outermost end of the male member and may be provided at an end of the male member which is radially inner and longitudinally outer of the male member attachment means. The primary surface of the male member may be distal of the longitudinally outermost end of the male member and may be provided radially outer and longitudinally inner of the male member attachment means.

The primary surface of the male member may include an at least partially tapered end which may form a shoulder portion and which may comprise a tapered portion angled with respect to an axis perpendicular to the longitudinal axis of the male member. The said tapered portion of the male member primary surface shoulder portion may be angled, from radially innermost to outermost, in the direction toward the rest of the male connecting member and which may be angled, from radially innermost to outermost, in the direction toward the male member attachment means. The said tapered angle may be in the region of 1 degree to 45 degrees, e.g., in the region of 10 to 20 degrees.

The primary surface of the female member may include a female shoulder portion and which may comprise a tapered portion angled with respect to an axis perpendicular to the longitudinal axis of the female member. The tapered portion of the female member primary surface shoulder portion may be angled, from radially innermost to outermost, in the direction toward the rest of the female connecting member and which may be angled, from radially innermost to outermost, in the direction toward the female member attachment means, perhaps by a substantially similar angle as that of the tapered portion of the male member primary surface shoulder portion such that the female member, and moreover, the longitudinally outermost end of the female member may be substantially prevented from moving radially outward when connected to the male member.

The secondary surface of the male member may include an at least partially tapered end which may form a shoulder portion and which may comprise a tapered portion angled with respect to an axis perpendicular to the longitudinal axis of the male member. The tapered portion of the male member secondary surface shoulder portion may be angled, from radially innermost to outermost, away from the rest of the male connecting member and which may be angled, from radially innermost to outermost, away from the male member attachment means. The said tapered angle may be in the region of 1 degree to 45 degrees, e.g., in the region of 10 to 20 degrees.

The secondary surface of the female member may include a female shoulder portion and which may comprise a tapered portion angled with respect to an axis perpendicular to the longitudinal axis of the female member. The said tapered portion of the female member secondary surface shoulder portion may be angled, from radially innermost to outermost, away from the rest of the female connecting member and which may be angled, from radially innermost to outermost, away from the female member attachment means, perhaps by a substantially similar angle as that of the tapered portion of the male member such that the male member, and moreover, the longitudinally outermost end of the male member may be substantially prevented from moving radially inward when connected to the female member.

The primary and secondary surfaces of the male and female connecting members may include support means which may further comprise a support platform or ledge adapted to support the respective longitudinally outermost ends of the male and female members when the connection means is engaged such that the male member is substantially prevented from moving radially outward and the female member may be substantially prevented from moving radially inward. The support means may be provided in the form of a surface, which may be a platform or ledge and which may be arranged to lie on an axis substantially parallel or co-axial to the longitudinal axis of the respective male and female connecting members.

The support means of the primary surface of the male member may be arranged radially inwardly of and longitudinally outwardly of the male member primary surface tapered portion and is further arranged radially outwardly of and longitudinally inwardly of the male member attachment means. The support means of the secondary surface of the male member may be arranged radially outwardly of and longitudinally inwardly of the male member secondary surface tapered portion and is further arranged radially inwardly of and longitudinally outwardly of the male member attachment means.

The support means of the primary surface of the female member may be arranged radially inwardly of and longitudinally inwardly of the female member primary surface tapered portion and is further arranged radially outwardly of and longitudinally outwardly of the female member attachment means. The support means of the secondary surface of the female member may be arranged radially outwardly of and longitudinally outwardly of the female member secondary surface tapered portion and is further arranged radially inwardly of and longitudinally inwardly of the female member attachment means.

The combined effect of the support means and tapered surfaces has the advantage that they substantially prevent movement (such as buckling when the connection means is being made up to high levels of torque) of the male and female connection members in the radial direction.

Optionally, the male connection member may be provided on one end of a body member and the female member provided on the other thereby creating a double shouldered connection which is capable of remaining engaged when a high torque is applied to it. Alternatively, one of a male or female member may be provided on one end of the member only, or in a further alternative, either a male or female member may be provided on each end of the body member.

The substantially tubular members may be members which are included in or make-up a drill string and may be members provided on or in a drilling jar, impact enhancing tool, drill pipe, flow circulation tool, shock tools, thrusters and bumper subs or other suitable tools such as any suitable Bottom Hole Assembly (BHA) tools.

These and other features, aspects, and advantages of the present invention will become more apparent from the following description, appended claims, and accompanying exemplary embodiments shown in the drawings.

DETAILED DESCRIPTION

Figures 1A, 1B, 1C:
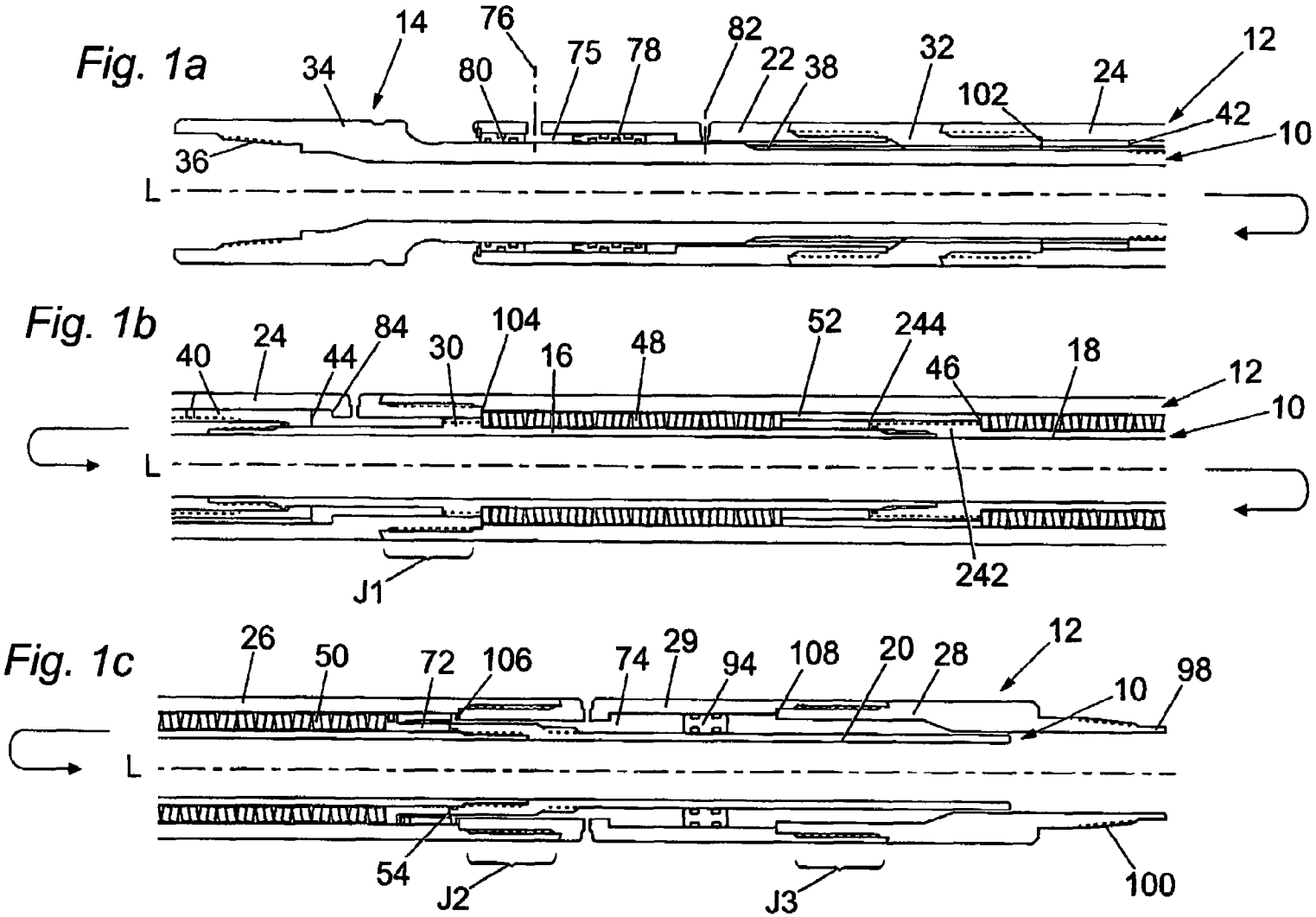
FIG. 1A is a cross-sectional view of an upper third of an impact enhancer apparatus in accordance with a first embodiment of the present invention.
FIG. 1B is a cross-sectional view of a middle third of the impact enhancer apparatus in accordance with the first embodiment of the present invention.
FIG. 1C is a cross-sectional view of a lower third of the impact enhancer apparatus in accordance with the first embodiment of the present invention.

Embodiments of the invention are illustrated in the drawings. An effort has been made to use the same, or like, reference numbers throughout the drawings to refer to the same or like parts.

When viewed in conjunction (as indicated by the connecting arrows) with one another, FIGS. 1A-1C show an impact enhancer apparatus in accordance with a first embodiment of the present invention.

The impact enhancer apparatus shown in FIGS. 1A-1C comprises an internal member or mandrel 10 surrounded by an external member or housing 12. The internal mandrel 10 is arranged such that it may move axially with respect to the outer housing 12.

The internal mandrel 10 is a substantially tubular member that spans the majority of the length from the upper to the lower end of the impact enhancer apparatus. The internal mandrel 10 comprises an uppermost connecting mandrel 14, which is connected at its lower end to an upper abutment mandrel 16. The upper abutment mandrel 16 is connected to a lower abutment mandrel 18. Finally, the lower abutment mandrel 18 is connected to a lowermost end mandrel 20.

The external housing 12 comprises an uppermost seal housing 22, which is connected to an upper abutment housing 24. The upper abutment housing 24 is connected to a lower abutment housing 26 (lock housing 26). Finally, the lower abutment housing 26 is connected to a lowermost connecting housing 28. It should be noted that the uppermost seal housing 22 is connected to the upper abutment housing 24 via a double shouldered spline 32, which will be described in more detail subsequently. Also, in this embodiment, each of the joints J1, J2 and J3 comprises corresponding threaded sections that are substantially parallel to the longitudinal axis L of the impact enhancer apparatus.

The uppermost connecting mandrel 14 of the internal mandrel 10 has a box section 34 provided with a standard tapered thread portion 36 that allows connection to a pin section of the lower end of an upper portion of a drill string (not shown). The box section 34 decreases in diameter to allow the connecting mandrel 14 to enter the external housing 12. Such box sections 34 are common in the industry and suitable box sections include the HT-50 and XT56 connections provided by Grant and Prideco and the WT-58 provided by Hydril. The mandrel 14 continues along the internal bore of the housing 12 until it reaches an indented portion 38 that comprises an arrangement of longitudinally extending and circumferentially spaced grooves that telescopically engage with internally projecting splines mounted on the spline 32, to prevent rotation from occurring between the internal mandrel 10 and external housing 12. At the lower portion of the connecting mandrel 14, a double headed hammer (or "stop") 40 is attached to the outer circumference of the mandrel 14. The hammer 40 comprises a collar, which has upper 42 and lower 44 stroke limiting surfaces that act to prevent overstressing of the springs as will be described subsequently.

With respect to FIG. 1B, the upper abutment mandrel 16 has a shoulder 30 formed around the circumference of the mandrel 16. The lower abutment mandrel 18 is provided with a female end socket 242 which creates upper 244 and lower 46 shoulders.

Resilient means or energy storage means, which include an upper compression spring stack 48 and a lower compression spring stack 50, are provided in the annulus created between the inner mandrel 10 and the external housing 12. A cylindrical spacer collar 52 is provided between the upper 48 and lower 50 stacks. The stacks 48, 50 are held within the annulus by a force that can be varied by screwing an adjuster 72 (which is coupled to the internal mandrel 10 by screw threads) either in or out, to increase or decrease (as desired) the initial compression force acting on the stacks 48, 50.

The secondary (upper) spring stack 48 comprises a hard spring and in the specific example given herein comprises a number of disk springs (such as Belleville springs) stacked adjacent each other. Each disk spring 48 comprises a toroid made from a suitable material, e.g., hardened steel, which has been pressed into a dish shape during manufacture. When a load is exerted on each disk spring 48, it will tend to flatten out of the disk shape imparted on it during manufacture. In this embodiment, the upper spring stack 48 comprises disks that alternate between four consecutive disks, which have their dish camber in one direction, and four consecutive disks, which have their dish camber in the opposite direction.

The lower spring stack 50 also comprises a number of disk springs 50 stacked adjacent each other. However, the lower spring stack 50 includes disks that alternate between two consecutive spring disks, which have their dish camber in one direction, and two consecutive disks, which have their dish camber in the opposite direction. The purpose of the differing spring orientation between the upper and lower stacks 48, 50 will be described subsequently.

The end mandrel 20 (shown in FIG. 1C) creates a chamber 74 between the end mandrel 20 outer circumference and the external housing 12. The end mandrel 20 also provides additional weight, which enhances the acceleration produced by the impact enhancer apparatus, to increase impact force generated by a drilling jar also located in the drill string.

The uppermost seal housing 22 of the external housing 12 provides a fluid chamber 75 that is provided with a moveable balance piston 78 and a seal 80. A fluid port 76, which is open to the surrounding bore, is also provided through the wall of the uppermost seal housing 22. A plug 82 is provided on the seal housing 22 to obturate another part but which is located below the balance piston 78, such that hydraulic fluid can be inserted into the annulus between the external housing 12 and internal mandrel 10. This arrangement prevents any pressure differential from building-up across the wall of the apparatus, as any relative increase in pressure below the piston 78 will be compensated by the piston 78 moving upwardly and any relative decrease in pressure below the piston 78 will be compensated by the piston 78 moving downward. This has the advantage of preventing the build-up of a pressure differential (which may damage or otherwise adversely affect operation of the tool) across the wall of the apparatus, while preventing hydraulic fluid in the apparatus from mixing with the oil/other material surrounding the apparatus.

The upper abutment housing 24 is provided with an internal shoulder 84 that is positioned such that it provides an impact surface against which the lower impact surface 44 of the stop 40 may come to rest. A shoulder 102 is provided on the spline 32 to provide an impact surface against which the upper impact surface 42 of the stop 40 may come to rest, as will be described in more detail subsequently.

The lower abutment housing 26 comprises a substantially tubular member that has a constant inner circumference within which the compression stacks 48, 50 are located.

A lower seal housing 29 provides the fluid chamber 74, which has a moveable balance piston 94. The lower seal housing 29 arrangement prevents any pressure differential from building-up across the wall of apparatus by providing a similar compensation system to that previously described for the upper seal housing 22.

The lowermost connecting housing 28 has a pin section 98 provided with a standard tapered thread portion 100 that allows connection to a standard box section of the upper end of a lower portion of the drill string (not shown).

It should be noted that a series of inwardly protruding shoulders 102, 104, 106 and 108 are created by the connections between each of the components making-up the external housing 12. Outwardly projecting shoulder 54 is also created on the internal mandrel 10 by the connection between lower abutment mandrel 18 and lowermost end mandrel 20 of the internal mandrel 10.

Figure 2B:
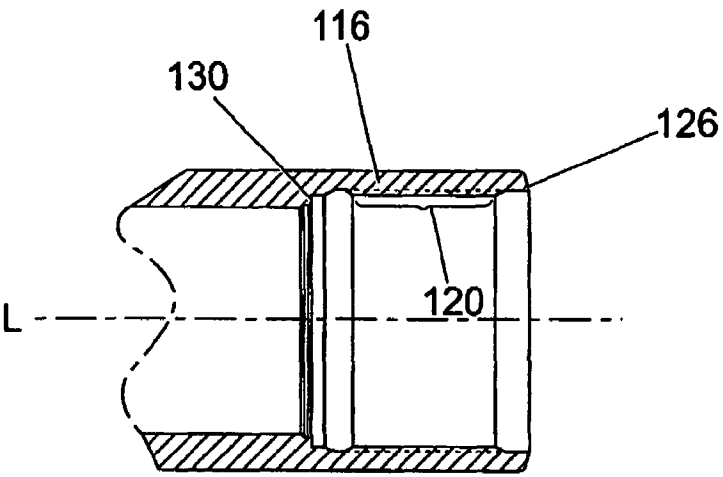
FIG. 2B is a further cross-sectional view of the female end connector of FIG. 2A in accordance with the second embodiment of the present invention.
Figure 2C:
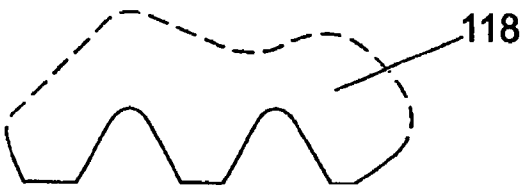
FIG. 2C is a detailed view of an internal screw thread of the female end connector of FIGS. 2A and 2B.
Figure 2A:
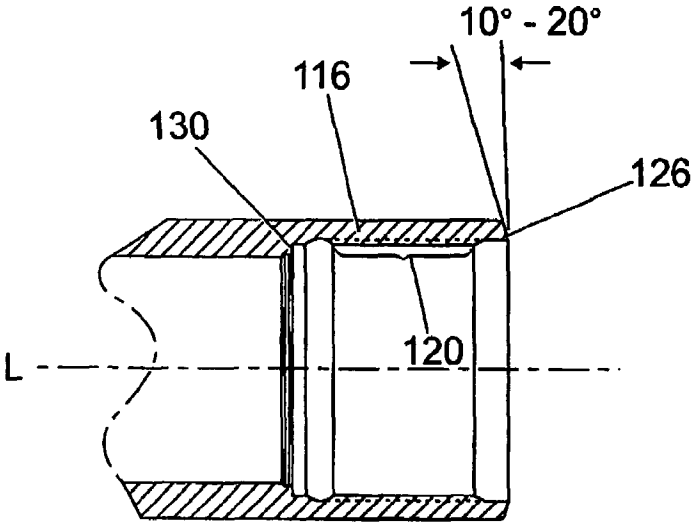
FIG. 2A is a cross-sectional view of a female end connector utilized in the impact enhancer apparatus of FIGS. 1A-1C, which female end connector is in accordance with a second embodiment of the present invention.
Figure 3B:
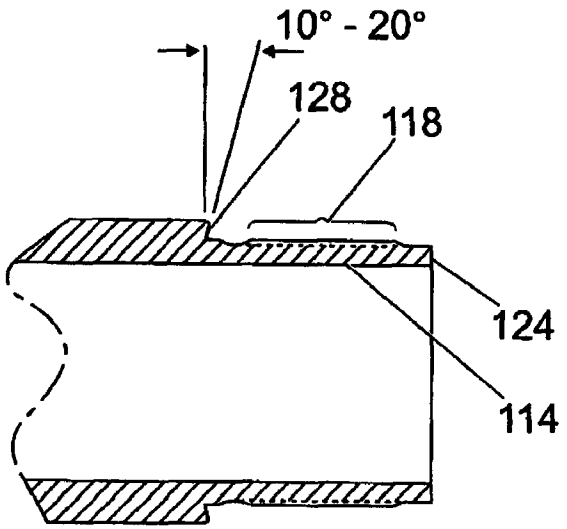
FIG. 3B is a further cross-sectional view of a male end connector to be used in conjunction with the female end connector of FIGS. 2A-2C in accordance with the second embodiment of the present invention.
Figure 3C:
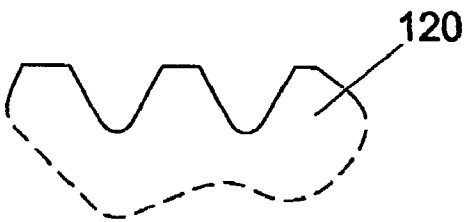
FIG. 3C is a detailed view of an external screw thread of the male connector of FIGS. 3A and 3B.
Figure 3A:
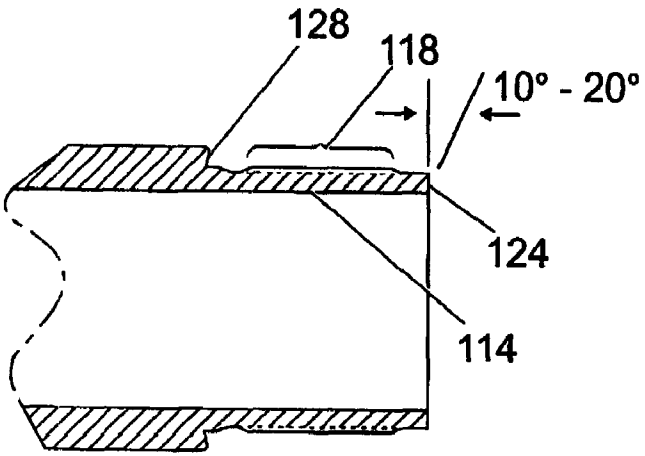
FIG. 3A is a cross-sectional view of a male end connector to be used in conjunction with the female end connector of FIGS. 2A-2C in accordance with the second embodiment of the present invention.

With reference to FIGS. 2A-2C, 3A-3C and 4, one embodiment of a connection means in accordance with a second embodiment of the present invention will now be described. In this embodiment, the connection means is incorporated into the impact enhancer apparatus (i.e., the mandrel 10 and housing 12) of FIGS. 1A-1C. The connection means includes an inner or male pin 114, which, when connected, resides within an outer or female box 116. A threaded portion 118 is provided on the outer circumference of the pin 114 and is formed such that it co-operates with a corresponding threaded portion 120 formed on the inner circumference of the box 116. As shown in FIGS. 2C and 3C, the threaded portions 118, 120 may include a V-shaped profile but could, in alternative embodiments, include square, buttress, trapezoidal or acme type threads.

Figure 4:
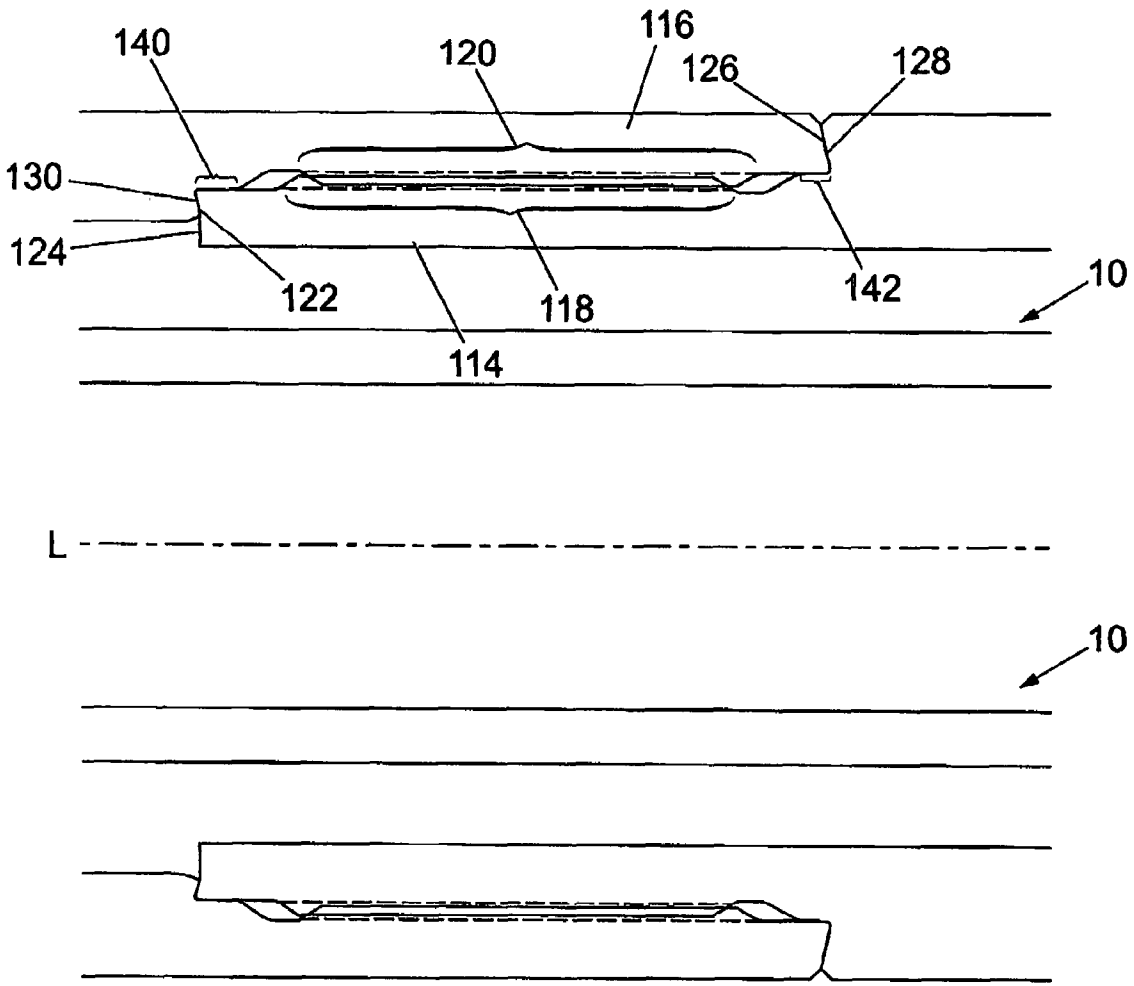
FIG. 4 is a detailed schematic diagram of a parallel threaded shoulder joint in accordance with the second embodiment of the present invention.

The threaded portions 118 and 120 are at or near parallel with the longitudinal axis L of the apparatus upon which the connection means is provided and, therefore, are referred to as parallel threads (as opposed to tapered threads commonly used, for instance, in drill pipe connections). The pin 114 has a shallow V-shaped or gull winged shaped indentation on its longitudinally outermost end face (i.e., the leftmost portion of the pin shown in FIG. 4). The indentation, which comprises a tapered wall 122 and a flat wall 124 (as shown in FIG. 4), will provide a secondary shoulder surface as will be described subsequently. The tapered wall 122 is angled with respect an axis that is perpendicular to the longitudinal axis L of the male pin 114. As shown in FIG. 4, the tapered wall 122 is angled at approximately 15 degrees (from radially innermost to outermost) away from the rest of the pin 114 (i.e., the rest of the pin 114 to the right of the flat wall 124) and, therefore, is angled (from radially innermost to outermost) away from the parallel thread 118.

Pin 114 also has a box receiving shoulder 128 that is distal of the tapered wall 122 and that is located radially outer and longitudinally inner of the thread 118, where the shoulder 128 will provide a primary shoulder surface as will be described subsequently. The shoulder 128 is angled with respect the axis that is perpendicular to the longitudinal axis L of the male pin 114. Specifically, the shoulder 128 is angled at approximately 15 degrees (from radially innermost to outermost) toward the rest of the pin 114 (i.e., the rest of the pin 114 to the left of the shoulder 128) and, therefore, is angled (from radially innermost to outermost) toward the parallel thread 118. Accordingly, the thread 118 is located radially and longitudinally between the shoulder 128 and the tapered wall 122.

The outer box 116 has a single tapered face 126 that provides a primary shoulder surface and that is angled with respect to the axis that is perpendicular to the longitudinal axis L of the outer female box 116. Specifically, the tapered face 126 is angled at approximately 15 degrees (from radially innermost to outermost) toward the rest of the outer female box 116 (i.e., the rest of the box 116 to the left of the tapered face 126) and, therefore, is angled (from radially innermost to outermost) toward the parallel thread 120 at substantially the same angle as that of the box receiving shoulder 128. The outer box 116 also has tapered pin receiving shoulder 130, which is distal of the tapered face 126, which is located radially and longitudinally inner of the female thread 120, and which will provide a secondary shoulder surface. As shown in FIG. 4, the pin receiving shoulder 130 is angled at approximately 15 degrees (from radially innermost to outermost) away from the rest of the box 116 (i.e., the rest of the box 116 to the right of the pin receiving shoulder 130) and, therefore, is angled (from radially innermost to outermost) away from the parallel thread 120. Thus, the tapered pin receiving shoulder 130 is provided with a substantially similar taper angle as that of tapered wall 122. Accordingly, the thread 120 is located radially and longitudinally between the tapered face 126 and the tapered pin receiving shoulder 130.

It should be noted that box 116 is at least equal to, and may be slightly longer than the length of inner pin 114 as will be discussed subsequently.

As shown in FIG. 1A, the connection means may be provided on both ends of a double shouldered spline 32. Each double shouldered spline 32 comprises a pin 114 and box section 116 that respectively connect, in accordance with the first embodiment of the present invention, to a box and pin section of another component of the apparatus upon which the spline 32 is installed.

With respect to FIG. 4, the pin 114 is screwed into the box section 116 when the impact enhancing tool is assembled; the threads 120 and 118 cooperate to cause tapered face 126 of the box 116 to abut against box receiving shoulder 128, thereby providing a primary (external of the thread) shoulder junction. This creates a metal to metal seal between the tapered face 126 and the shoulder 128 and also provides a primary shoulder between the pin 114 and box 116 into which torque can be delivered and stored.

Tapered wall 122 also abuts against pin receiving shoulder 130, thereby creating a secondary (internal of the thread) metal to metal seal between the tapered face 126 and the shoulder 128. The abutment of tapered wall 122 and should 130 also provides a secondary shoulder joint between the pin 114 and box 116 into which torque can be delivered and stored. However, as discussed previously, the length of box 116 is manufactured such that it is at least equal to that of pin 114, and may be slightly longer (e.g., about 0.15 mm) than the length of pin 114. This ensures that the seal created between face 126 and shoulder 128 is made before the seal between wall 122 and shoulder 130. Therefore, the seal between face 126 and shoulder 128 is regarded as the primary shoulder joint and the internal seal between the wall 122 and shoulder 130 is regarded as the secondary shoulder joint.

When the impact enhancing tool is located in a drill string along with a drilling jar and the drill string is compressed when, for example, downward jarring is required (or tensioned when, for example, upward jarring is required) pin 114 is prevented from splaying inwardly toward the longitudinal axis L of the apparatus upon which the connection means is provided due to the abutment between the tapers on wall 122 and shoulder 130. The pin 114 is also prevented from diving outwardly (away from the longitudinal axis L) due to a support means in the form of support ledge 140 on the box section 116, where the support ledge 140 is arranged to lie on an axis substantially parallel and co-axial to the longitudinal axis L of the female box section 116. As shown in FIG. 4, the support ledge 140 is arranged radially outwardly of and longitudinally outwardly of the pin receiving shoulder 130 and is, therefore, located radially inwardly of and longitudinally inwardly of the female thread 120.

Box section 116 is prevented from splaying outwardly away from the longitudinal axis L of the apparatus due to the taper on wall 126 and shoulder 128. The box 116 is also prevented from diving inwardly (toward longitudinal axis L) due to a support ledge 142 on the pin section 114. As shown in FIG. 4, the support ledge 142 is arranged radially inwardly of and longitudinally outwardly of the male shoulder 128 and is, therefore, located radially outwardly of and longitudinally inwardly of the male thread 118.

This provides a very secure joint that will withstand very high torsional forces, without the pin 114 or box 116 sections splaying or diving inwardly/outwardly, as the combined effect of the support ledges 140, 142 and tapered surfaces 122/130, 126/128 substantially prevents movement of the male pin 114 and female box 116 in the radial direction. The joint created by the connection means also discourages unintentional backing off (i.e., unscrewing) of the components of the apparatus upon which the connection means is provided since a large rotational force would be required in order to overcome the friction between the primary or external shoulder joint 126/128 (face 126 and wall 128) and secondary or internal shoulder joint 122/130 (face 122 and wall 130), once the desired make-up torque has been applied to the connection.

The parallel arrangement of threaded portions 118 and 120 allow a secure connection to be created between two tubular members, while using a minimal amount of borehole space/radial distance. In other words, the joints do not encroach on the internal bore more than absolutely necessary, as no taper is required on the threaded portions 118 and 120.

In addition, the connection means prevents over stretching of the pin 114 and box 116 sections (which often occurs in standard tapered thread pin and box joints) from occurring both during connection of the tubular members and during operation of the drill string. Any tendency for the pin 114 or box 116 to over stretch is avoided by the inability of the pin 114 and box 116 to increase in length due to the respective shoulders 122/130 and 126/128. Accordingly, the connection means permit a much higher level of torque to be applied to itself when screwing the connections together as compared to conventional connections which is particularly useful in extended reach/horizontal wells.

The connection means is not limited to use on the spline 32 and indeed the impact enhancing apparatus shown in FIGS. 1A-1C is provided with further joints J1, J2, J3 and J4, each of which has: (a) a similarly tapered arrangement; and (b) threaded portions that are substantially parallel to the longitudinal axis L of the impact enhancing apparatus. Furthermore, the connection means is not limited to use on an impact enhancing apparatus and indeed it may be used on virtually any tool or tubular in which a high torque connection between tubular members may be required, e.g., drilling jar, accelerators, drill pipe, flow circulation tools, shock tools, thrusters, and bumper subs, etc. and any other suitable BHA tools.

In operation, the impact enhancer apparatus is installed in the drill string prior to inserting the drill string downhole, and is normally installed above a drilling jar (not shown). In the event that the drill string becomes stuck downhole (due to, for example, the drill bit becoming lodged in the formation being drilled) the impact enhancer helps free the drill string by increasing the jarring force exerted by the jar apparatus.

Depending upon the nature of the jam between the drill string and the formation, the operator may chose to jar the drill string in the upward or the downward direction, or by alternating between both directions. When jarring the drill string in the upward direction, it is desirable that the impact enhancer be capable of storing a large amount of energy since drill strings are inherently able to withstand high tensile forces. However, when jarring the drill string in the downward direction, it is desirable that a smaller amount of energy be stored in the impact enhancer apparatus, as drill strings are inherently less able to withstand high compressive forces. Although conventional double acting impact have this capability, such conventional impact enhancers undesirably require complete compression of the resilient means when the high compressive force is exerted on the drill string, which is likely to result in buckling of the drill string.

When jarring the drill string in the upward direction, the upper portion of the drill string is pulled upwardly by the operator via the drilling rig (not shown). This exerts an upward force on the internal mandrel 10 with respect to the external housing 12 (which is prevented from moving upwardly due to the stuck drill bit (not shown)). The upward movement of the internal mandrel 10 causes outwardly projecting shoulder 54 on lowermost end mandrel 20 to abut against adjuster 72, which causes the lower spring stack 50 to be forced against spacer collar 52. Spacer collar 52, in turn, pushes upper spring stack 48 against inwardly protruding shoulder 104 on the external housing 12. The skilled reader will, therefore, note that at this point both the upper 48 and lower 50 spring stacks are being compressed as the inner mandrel 10 moves upwardly, and thus storage of energy is built-up within both upper 48 and lower 50 spring stacks. However, the arrangement of the disk springs on the lower spring stack 50 allows the upper spring stack 48 to be compressed more easily than the lower spring stack 50 and, therefore, the upper spring stack 48 will tend to compress far more under pressure than the lower spring stack 50 at this point.

With respect to FIGS. 1A-1C, the arrangement of the spring stacks 48 and 50 will now be described. The upper spring stack 48 comprises paired sets disks. Each set of disks comprises four disks that arranged adjacent each other in parallel. For illustrative purposes only, if the maximum compression allowable by each disk set is say 10 mm, then the total compression distance available by completely flattening all eights disks in a paired set of disks is 20 mm. However, if the disks are arranged in sets of two parallel disks, as the case in the lower spring stack 50, the total compression distance available by completely flattening four disks (i.e., two sets of two disks in parallel) is 20 mm but only requires half the compression force. Therefore, when the primary stack 50 is compressed by a force F, the resulting compression displacement will be the same as the secondary stack under twice the force F.

While each spring stack 48, 50 is being compressed, the lower shoulder 46 on the female socket 242 of the lower abutment mandrel 18 gradually moves away from the lower spring stack 50 and toward the upper spring stack 48. When the upper shoulder 244 meets the upper stack 48, further compression of the lower stack 50 is avoided. Further compression is avoided because further upward movement of the internal mandrel 10 allows the spacer collar 52 to move upward, as the lower end of the upper spring stack 48 is now forced upward, and is supported by, surface shoulder 244 of the female end socket 242. Thus, continued upward movement of the internal mandrel 10 results in continued compression of the upper spring stack 48 but no further compression of the lower spring stack 50. This is advantageous because total compression of the disk springs of the lower spring stack 50 is avoided. As will be understood by the skilled reader, pulling against the large resilient force provided by the stacks 48, 50 requires very large forces to be exerted on internal mandrel 10. This force is provided by pulling upon the internal mandrel 10 via the drill string using the drill rig (not shown).

When the jar apparatus (not shown) located in line with the present impact enhancer apparatus is fired in the upward direction, the energy stored within the upper and lower stacks 48 and 50 is released due to the disk springs wishing to return to their relaxed configuration, as shown in FIGS. 1A-1C. This release of energy will act on the inner mandrel 10 to provide a large acceleration force on the external housing 12, which accelerates the inner mandrel of the jar apparatus, thereby causing a far greater impact to occur between the hammer and anvil (or other) on the jar apparatus. In this regard, it should be noted that the outer housing 12 of the impact enhancer is connected to the inner mandrel of the jar apparatus.

When jarring the drill string in the downward direction, the upper portion of the drill string is effectively pushed downwardly by the operator via the drilling rig (not shown) by letting off weight at the drilling rig. This exerts a downward force on the internal mandrel 10 with respect to the external housing 12 (which is prevented from moving downwardly due to the stuck drill bit (not shown)). The downward movement of the internal mandrel 10 causes lower shoulder 46 on the female end socket 242 to compress lower spring stack 50 against the adjuster 72; the adjuster 72 is prevented from moving any further down the apparatus due to inwardly projecting shoulder 106 on the external housing 12. The upper spring stack 48 is not compressed by downward movement of the inner mandrel 10, as the lower spring stack is compressed by shoulder 46. Therefore, the upper spring stack 48 simply moves along with shoulders 30, 46 and spacer collar 52, without being compressed therebetween.

When the jar apparatus (not shown) located in line with the present impact enhancer apparatus is fired in the downward direction, only the resilient force from the energy stored in the lower stack 50 acts on the external housing 12. The energy stored in the lower stack 50, which acts on the external housing 12, provides an acceleration force on the external housing 12 that accelerates the inner mandrel of the jar apparatus, thereby causing a far greater impact to occur between the hammer and anvil (or other) on the jar apparatus.

It should be noted that the double headed hammer 40 acts in conjunction with shoulders 84 and 102 to act as stroke limiters that prevent over stressing of spring stacks 48 and 50.

The stroke length of the impact enhancer apparatus is designed such that it is less than the stroke length of the jar apparatus with which it is used. This ensures that the impact enhancer imparts all of its acceleration force upon the hammer (not shown) of the jar apparatus before the jarring impact occurs.

Although the aforementioned describes embodiments of the invention, the invention is not so restricted. For instance, the parallel threads 118, 120 could in certain circumstances, be replaced by linearly tapering threads if, for instance, increasing the radial extent of the connection was acceptable in a given downhole tool or other tubular member. It should also be noted that the outer circumference of the tubular members, which were described herein as being circular in cross-section, need not be so. Rather, the outer circumference of the tubular members could have other cross-section such, e.g., square, hexagonal, etc.; such alternate cross-sections may be particularly applicable in the areas in between the connection means.

It light of the foregoing, it will be apparent to those skilled in the art that various modifications and variations can be made to the disclosed embodiments of the present invention without departing from the scope or spirit of the invention. Accordingly, these other apparatuses and methods are fully within the scope of the claimed invention. Therefore, it should be understood that the apparatuses and methods described herein are illustrative only and are not limiting upon the scope of the invention, which is indicated by the following claims.

What is claimed is:

1. An impact enhancer apparatus comprising:

a substantially tubular inner member;

a substantially tubular outer member which is axially movable in relation to the inner member; and a primary energy storage device adapted to store enemy when the inner member is moved in either of upward and downward axial directions with respect to the outer member; and a secondary energy storage device adapted to store energy when the inner member is moved in the upward axial direction with respect to the outer member;

wherein the primary and secondary energy storage device are adapted to resist movement of the inner member in the upward axial direction with respect to the outer member with a larger resistive force than when the primary energy storage device resists movement of the inner member in the downward axial direction with respect to the outer member.

2. An impact enhancer apparatus according to claim 1, wherein the primary energy storage device comprises a primary biasing device.

3. An impact enhancer apparatus according to claim 2, wherein the primary biasing device is any one of a spring device selected from the group consisting of: disk springs; coiled springs; fluid and gas springs.

4. An impact enhancer apparatus according to claim 1, wherein the secondary energy storage device comprises a secondary biasing device.

5. An impact enhancer apparatus according to claim 4, wherein the secondary biasing device is any one of a spring device selected from the group consisting of: disk springs; coiled springs; fluid and gas springs.

6. An impact enhancer apparatus according to claim 1, wherein the primary energy storage device is adapted to store energy when compressed by movement of the inner member in either of the first and second axial directions with respect to the outer member.

7. An impact enhancer apparatus according to claim 1, wherein the secondary energy storage device is adapted to store energy when compressed by movement of the inner member in the first axial direction with respect to the outer member.

8. An impact enhancer apparatus according to claim 1, wherein the primary energy storage device is adapted to resist upward movement of the inner member with respect to the outer member by a first resilient force when the inner member is displaced to an upward displacement boundary.

9. An impact enhancer apparatus according to claim 8, wherein the secondary energy storage device is adapted to resist upward movement of the inner member with respect to the outer member by a second resilient force when the inner member is displaced past the upward displacement boundary.

10. An impact enhancer apparatus comprising:

a substantially tubular inner member;

a substantially tubular outer member which is axially movable in relation to the inner member; and a primary energy storage device adapted to store energy when the inner member is moved in either of upward and downward axial directions with respect to the outer member; and a secondary energy storage device adapted to store energy when the inner member is moved in the upward axial direction with respect to the outer member;

wherein the primary energy storage device is adapted to provide a lower level of resistive force to compression than that provided by the secondary energy storage device.

11. An impact enhancer apparatus according to claim 10, wherein the difference in the level of resistive force provided by the energy storage device is determined due to the orientation of the energy storage device which selectively results in a greater or lesser compression displacement when substantially the same force is placed upon the energy storage device.

12. An impact enhancer apparatus comprising:

a substantially tubular inner member;

a substantially tubular outer member which is axially movable in relation to the inner member; and a primary energy storage device adapted to store energy when the inner member is moved in either of upward and downward axial directions with respect to the outer member; and a secondary energy storage device adapted to store energy when the inner member is moved in the upward axial direction with respect to the outer member;

wherein the primary energy storage device comprises a plurality of spring disks oriented in the same direction as one another;

wherein the plurality of disks in the primary energy storage device are arranged with a number of disks oriented in one direction alternating with a number of disks oriented in the other direction.

13. An impact enhancer apparatus according to claim 12, wherein the secondary energy storage device comprises a plurality of spring disks oriented in the same direction as one another.

14. An impact enhancer apparatus according to claim 13, wherein the plurality of disks in the secondary energy storage device are arranged with a greater number of disks of the primary energy storage device oriented in one direction alternating with the same greater number of spring disks oriented in the other direction.

15. An impact enhancer apparatus comprising:

a substantially tubular inner member;

a substantially tubular outer member which is axially movable in relation to the inner member; and a primary energy storage device adapted to store energy when the inner member is moved in either of upward and downward axial directions with respect to the outer member; and a secondary energy storage device adapted to store energy when the inner member is moved in the upward axial direction with respect to the outer member;

wherein the primary and secondary energy storage devices are located in a respective annulus formed between the inner and outer members;

wherein the primary energy storage device is further located between a second arrangement of upper and lower shoulders formed on the inner member and a lower shoulder formed on the outer member and a lower shoulder formed on a moveable member;

wherein the secondary energy storage device is further located between a first arrangement of upper and lower shoulders formed on the inner member and an upper shoulder formed on the outer member and an upper shoulder formed on a moveable member;

wherein the moveable member is located in the annulus located between the primary and secondary energy storage devices; and wherein the moveable member comprises a greater axial extent and thus a greater distance between its upper and lower shoulders than the distance between the inner member lower shoulder of the first arrangement and the inner member upper shoulder of the second arrangement.

16. An impact enhancer apparatus according to claim 15, wherein the impact enhancing apparatus is arranged such that, in the absence of compression to the energy storage device, the distance between the upper shoulder of the first arrangement and the upper shoulder of the second arrangement substantially equals the distance between the upper shoulder of the outer member and the lower shoulder of the moveable member.

17. A method of increasing the jarring force imparted by a jar apparatus comprising:

providing a substantially tubular inner member;

providing a substantially tubular outer member;

providing an energy storage device capable of storing greater energy therein due to upward movement of the inner member with respect to the outer member;

wherein the energy storage device comprises a primary and a secondary energy storage device;

moving the inner member in the upward direction to thereby cause the primary and secondary energy storage device to be compressed;

including moving the inner member in the downward direction and moving the secondary energy storage device with the inner member to thereby cause only the primary energy storage device to be compressed.

18. A method according to claim 17, including providing an upward displacement limit so that on reaching the upward displacement limit, further upward movement of the inner member causes the secondary energy storage device to be compressed further.

19. An impact enhancer apparatus comprising:

a substantially tubular inner member;

a substantially tubular outer member which is axially movable in relation to the inner member; and a compressible primary energy storage device comprising a level of resistive force to compression and in which energy is stored due to compression thereof when the inner member is moved in either of first and second axial directions with respect to the outer member;

a compressible secondary energy storage device comprising a level of resistive force to compression and in which energy is stored due to compression thereof but only when the inner member is moved in the first axial direction with respect to the outer member;

wherein the apparatus permits more energy to be stored, in both the primary and secondary energy storage devices, when the inner member is moved in the first axial direction over a certain distance with respect to the outer member compared with the amount of energy permitted to be stored in the primary energy storage device when the inner member is moved in the second axial direction over the same distance.

* * * * *